US007497105B2

(12) United States Patent
Anagnostopoulos

(10) Patent No.: US 7,497,105 B2
(45) Date of Patent: Mar. 3, 2009

(54) MACHINE AND METHOD FOR PARALLEL PRODUCTION OF SIMILAR PRODUCTS, THROUGH STRAIGHTENING AND BENDING OF WIRES, WIRE RODS, METAL TUBES OR OTHER MATERIAL OF PRISMATIC CROSS SECTION

(76) Inventor: Antonios Anagnostopoulos, 1 Vitsiou and Eleftherotrias, Kiffisia, Attikis (GR) GR-14562

( * ) Notice: Subject to any disclaimer, the term of this patent is extended or adjusted under 35 U.S.C. 154(b) by 0 days.

(21) Appl. No.: 11/469,925

(22) Filed: Sep. 5, 2006

(65) Prior Publication Data

US 2007/0017271 A1 Jan. 25, 2007

Related U.S. Application Data

(63) Continuation of application No. 10/493,025, filed as application No. PCT/GR03/00019 on Jun. 3, 2003, now abandoned.

(30) Foreign Application Priority Data

Jun. 5, 2002 (GR) ..... 020100266

(51) Int. Cl.
*B21D 11/00* (2006.01)

(52) U.S. Cl. ..... 72/307; 72/404

(58) Field of Classification Search ..... 72/307, 72/306, 149, 404, 161, 215–217, 387, 388, 72/442, 294, 135, 142, 144, 299; 140/139, 140/140, 147; 29/33 F, 33 T See application file for complete search history.

(56) References Cited

U.S. PATENT DOCUMENTS 813,215 A 2/1906 Juengst (Continued)

FOREIGN PATENT DOCUMENTS

DE 3617986 A1 12/1987

(Continued)

OTHER PUBLICATIONS

OBI Greek National Patent Office, "Search Report Ekthesi Erevnas for Greek National Application No. 2002010266" compiled Jul. 29, 2003.

*Primary Examiner*—Dana Ross
*Assistant Examiner*—Debra M Wolfe
(74) *Attorney, Agent, or Firm*—George Kapsalas; Patenbuero Paul Rosenich AG

(57) ABSTRACT

A machine and method for parallel production of similar products by wires, wire rods, tubes, or other material of prismatic cross section, which is characterized by existence of more than one production lines, which operate in parallel and which may comprise similar mechanisms for straightening and bending of the material, similar mechanisms for changing of the bending plane, and for cutting of the final parts. All the straightening mechanisms may be driven by a common motor, through a common driving mechanism; all the bending mechanisms may be driven by a common motor, through a common driving mechanism; all the mechanisms for the changing of the bending plane may also be driven by a common motor, through a common driving mechanism; and all the cutters may be driven by a common power source. All the operation of the motors and of the driving mechanisms may be controlled and programmed by one common controlling unit.

67 Claims, 3 Drawing Sheets

U.S. PATENT DOCUMENTS

| | | | | | |
|---|---|---|---|---|---|
| 957,200 | A | * | 5/1910 | Gail | 72/212 |
| 1,546,147 | A | * | 7/1925 | Skinner | 72/217 |
| 2,072,230 | A | * | 3/1937 | Weiss | 140/71 R |
| 3,145,757 | A | | 8/1964 | Sheehan | |
| 3,373,587 | A | * | 3/1968 | Shubin et al. | 72/158 |
| 3,922,901 | A | | 12/1975 | Hillegas et al. | |
| 4,166,370 | A | * | 9/1979 | Goodman | 72/105 |
| 4,351,178 | A | * | 9/1982 | Uehara et al. | 72/383 |
| 4,391,115 | A | * | 7/1983 | Slattery et al. | 72/131 |
| 4,716,754 | A | | 1/1988 | Youngs | |
| 5,020,575 | A | | 6/1991 | Grabuschnig et al. | |
| 5,170,654 | A | | 12/1992 | Anagnostopoulos | |
| 5,182,932 | A | * | 2/1993 | Ritter et al. | 72/217 |
| 5,197,320 | A | | 3/1993 | Saegusa | |
| 5,511,402 | A | | 4/1996 | Kauffman | |
| 5,873,278 | A | | 2/1999 | Saegusa | |
| 6,295,857 | B1 | * | 10/2001 | Rupoli | 72/307 |
| 6,434,995 | B1 | * | 8/2002 | Kataoka et al. | 72/307 |
| 6,494,353 | B2 | | 12/2002 | Small et al. | |

FOREIGN PATENT DOCUMENTS

| | | | |
|---|---|---|---|
| DE | 19953284 | A1 | 5/2001 |
| EP | 0209876 | A | 1/1987 |
| EP | 0263607 | A1 | 4/1988 |
| EP | 0432468 | A | 6/1991 |
| EP | 0554533 | A1 | 8/1993 |
| GB | 403558 | A | 12/1933 |
| JP | S57-007330 | A | 1/1982 |
| JP | S62-270236 | A | 5/1988 |
| JP | H07-148537 | A | 10/1995 |
| WO | 95/017986 | A2 | 7/1995 |

* cited by examiner

MACHINE AND METHOD FOR PARALLEL PRODUCTION OF SIMILAR PRODUCTS, THROUGH STRAIGHTENING AND BENDING OF WIRES, WIRE RODS, METAL TUBES OR OTHER MATERIAL OF PRISMATIC CROSS SECTION

CROSS-REFERENCE TO RELATED APPLICATIONS

This application is a continuation of U.S. application Ser. No. 10/493,025, now abandoned, which has an international filing date of Jun. 3, 2003 and a 35 USC sec.371(c) date of Apr. 19, 2004. Application Ser. No. 10/493,025 is a national-phase entry under 35 USC sec.371 of PCT application no. PCT/GR03/00019 which has an international filing date of Jun. 3, 2003. The priority of U.S. application Ser. No. 10/493,025 and of international application PCT/GR03/00019 is claimed, and the entirety of both of these prior applications is incorporated herein by reference. Furthermore, foreign priority of Greek application no. 20020100266 filed Jun. 5, 2002 is also claimed.

BACKGROUND OF THE INVENTION

1. Field of the Invention

The present invention refers to a method and a machine for parallel production of similar products, by straightening and bending mechanisms. The supplied material is wire, wire rod or any other material of prismatic cross section, and it may be fed simultaneously at several production lines, where controlling and driving is common.

The products are widely used in the construction of machine parts, of various consumer products made of wire, of products made of wire rods, and of parts made of metal tubes.

2. Description of Related Art

The machines, which are available in the market, consist of one straightening and one feeding mechanism, which straighten and advance the wire respectively, and of one bending mechanism, for bending at a single plane (2-D) or at multiple planes (3-D). Each mechanism disposes its own independent motor, its own means for measuring of length or rotation angle, and its own means for transferring of motion from the motor towards each particular mechanism. Furthermore, the machine disposes a central computer for programming (planning) of the production parts and for controlling of the various mechanisms' motion.

Any competitors' machines exhibit the above characteristics but they differ from each other with respect to the straightening method, the advancement mechanism, and the bending mechanism.

Starting from the supplied material, each machine constructs products in a serial mode, one after the other. The need for high productivity leads to the construction of very fast machines, which operate at high speeds, and hence they have particular requirements of robustness, housing, construction material, and high-speed electronic controllers. As a direct consequence of this, the resulting machines are very complicated and particularly expensive.

As an example, the only way for doubling the production in a given production line, is by introduction of another similar machine, which disposes all the mechanisms, motors and electronics parts, which were mentioned previously. This is an expensive solution, since it requires procurement of another machine.

SUMMARY OF THE INVENTION

It is an object of the present invention to present a method, which will resolve the problems of the existing methods, and will lead to the construction of a simple-in-design, low-cost, and high-productivity machine.

Another object of the present invention is to describe a machine, which implements the method of the invention, where the machine exhibits high productivity at lower production cost, less machine bulk, and automated operation.

It is a further object of a version of the invention to provide a machine for production of similar products from wire, that may comprise at least two wire advancement mechanisms; a first drive shaft kinematically connecting said at least two advancement mechanisms; a first motor operatively linked to said first drive shaft for driving said at least two advancement mechanisms; at least two wire straightening mechanisms each being respectively disposed for receiving wire from a respective one of said at least two wire advancement mechanisms; at least two wire bending mechanisms each being respectively disposed so as to receive wire each from a respective one of said at least two wire straightening mechanisms; a second drive shaft kinematically connecting said at least two wire bending mechanisms; a second motor operatively linked to said second drive shaft for driving said bending mechanisms; and, a control unit operatively controlling said first and second motors for forming bent wire products at each of said at least two bending mechanisms.

It is also a further object of versions of the invention to provide a machine for production of similar products from wire, which may comprise at least two wire advancement mechanisms; a first drive shaft kinematically connecting said at least two advancement mechanisms; a first motor operatively linked to said first drive shaft for driving said at least two advancement mechanisms; at least two bending plane selection mechanisms each being respectively disposed for receiving wire each from a respective one of said at least two wire advancement mechanisms; a third motor linked to drive said at least two bending plane selection mechanisms for selectively rotating the respective wires; at least two wire bending mechanisms each being respectively disposed so as to receive wire each from a respective one of said at least two bending plane selection mechanisms; a second drive shaft kinematically connecting said at least two wire bending mechanisms; a second motor operatively linked to said second drive shaft for driving said at least two bending mechanisms; and, a control unit operatively controlling said first and second motors for advancing two wires and for forming bent wire products at each of said at least two bending mechanisms.

It is also a further object of versions of the invention to provide a method for production of similar products from wire comprising, advancing a first wire from a supply through a first wire advancement mechanism by operating a first motor; advancing a second wire from a second supply through a second wire advancement mechanism by operating the first motor; passing the first wire through a first straightening mechanism to straighten the first wire; passing the second wire through a second straightening mechanism to straighten the second wire; feeding the first wire through a first bending plane selection mechanism; feeding the second wire through a second bending plane selection mechanism; receiving the first wire at a first bending mechanism; receiving the second wire at a second bending mechanism; and, operating a second motor to operate the first and second wire bending mechanisms so as to bend the first and second wires.

It is a yet further object of versions of the invention to provide a machine for production of wire products comprising a bending unit, the bending unit including a first bending mechanism, the bending unit including a second bending mechanism, with a first motor configured to drive said first and second bending mechanisms; a first bending plane selection mechanism configured to selectively axially rotate wire passing therethrough to said first bending mechanism, and, a second bending plane selection mechanism configured to selectively axially rotate wire passing therethrough to said second bending mechanism.

As a still further object of versions of the invention, there is provided a machine for production of wire products comprising a bending unit, said bending unit including a first bending mechanism, said bending unit including a second bending mechanism; and, a first bending plane selection mechanism configured to selectively axially rotate wire passing therethrough to said first bending mechanism, a second bending plane selection mechanism configured to selectively axially rotate wire passing therethrough to said second bending mechanism, and, a motor configured to drive said first and second bending plane selection mechanisms to effect the selective axial rotation of the respective wires passing through said first and second bending plane selection mechanisms.

In yet a further object of versions of the invention, there is provided a method for production of wire products comprising the steps of feeding a first wire through a first bending plane selection mechanism, feeding a second wire through a second bending plane selection mechanism, receiving the first wire at a first bending mechanism, receiving the second wire at a second bending mechanism; and, operating a first motor to drive the first and second bending plane selection mechanisms to selectively axially rotate the first and second wires.

More details about the machine and method according to the present invention will be better comprehended during the following description of versions of the invention. The machine and method are described in the attached figures, in the sense of non-restrictive examples and without limitation in the range of the applications of the apparatus and method. These and other features, aspects, and advantages of the present invention will become better understood with regard to the following description, appended claims, and accompanying drawings, where:

DETAILED DESCRIPTION

Definitions: For simplicity and ease of reference thereto, the terms "wire," "wire rods," "rods," "tubes," and "material of prismatic cross-section" are used interchangeably and equivalently throughout the remainder of the detailed description and appended claims. Thus artisans in the art will readily understand that the term "rods" within the appended claims encompasses and includes the aforesaid "wire," "tubes," and generally "material of prismatic cross-section" without differentiation unless such differentiation is explicitly set forth. Thus, known utilizable materials of prismatic cross-section may be conveniently and clearly referred to in non-limiting brief form by the terms "rods," or "wires."

Figure 1:
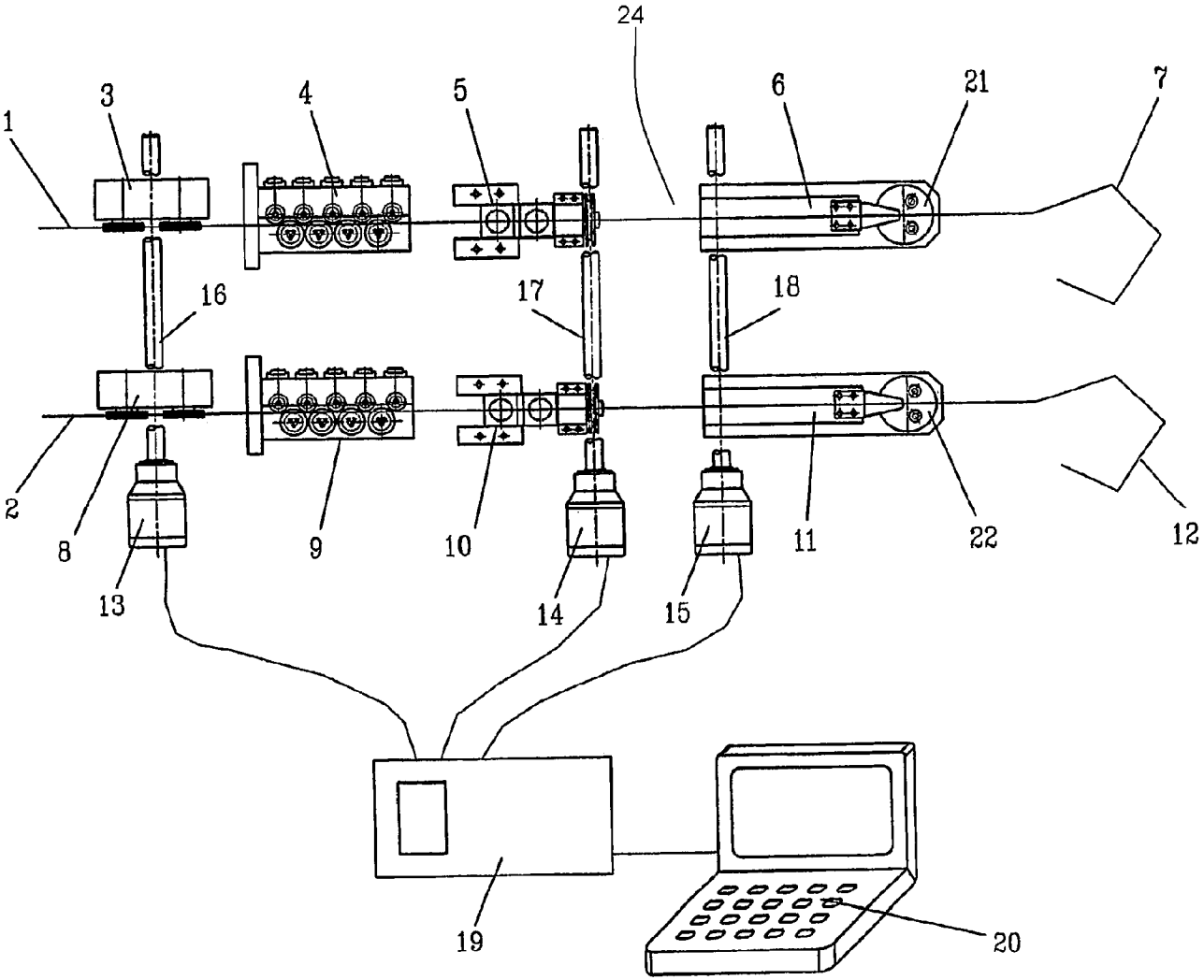
FIG. 1 is a schematic view according to a version of the present invention.

A version of the invention is schematically presented in FIG. 1. The wire (1) is pulled from a reel, where it is stored, and is fed on a first feed path towards the straightening mechanism (4) through the advancement mechanism (3). Advancement is usually implemented through roller pairs, which press the wire, rotate, and therefore advance it. The advancement rollers move through the drive mechanisms (16), which are driven by the motor (13). By controlling the motor (13), the advancement of the material (1) is also controlled.

Consequently, the material (1) advances to a bending unit (24) that includes the bending mechanism (6), where it is bent via rotation of a moving pin about a fixed pin. The bending angle depends on the operation of the motor (15), which drives the rotating pin, through the mechanism (18). When production of each part is completed, the material (1) may be cut.

In versions of the invention, the operation plane of the bending mechanism (6), which is defined by the fed and the bent wire, can be changed upon rotation (5) with respect to the axis of the longitudinal wire (1), through the mechanism (17), which is driven by the motor (14).

Figure 2:
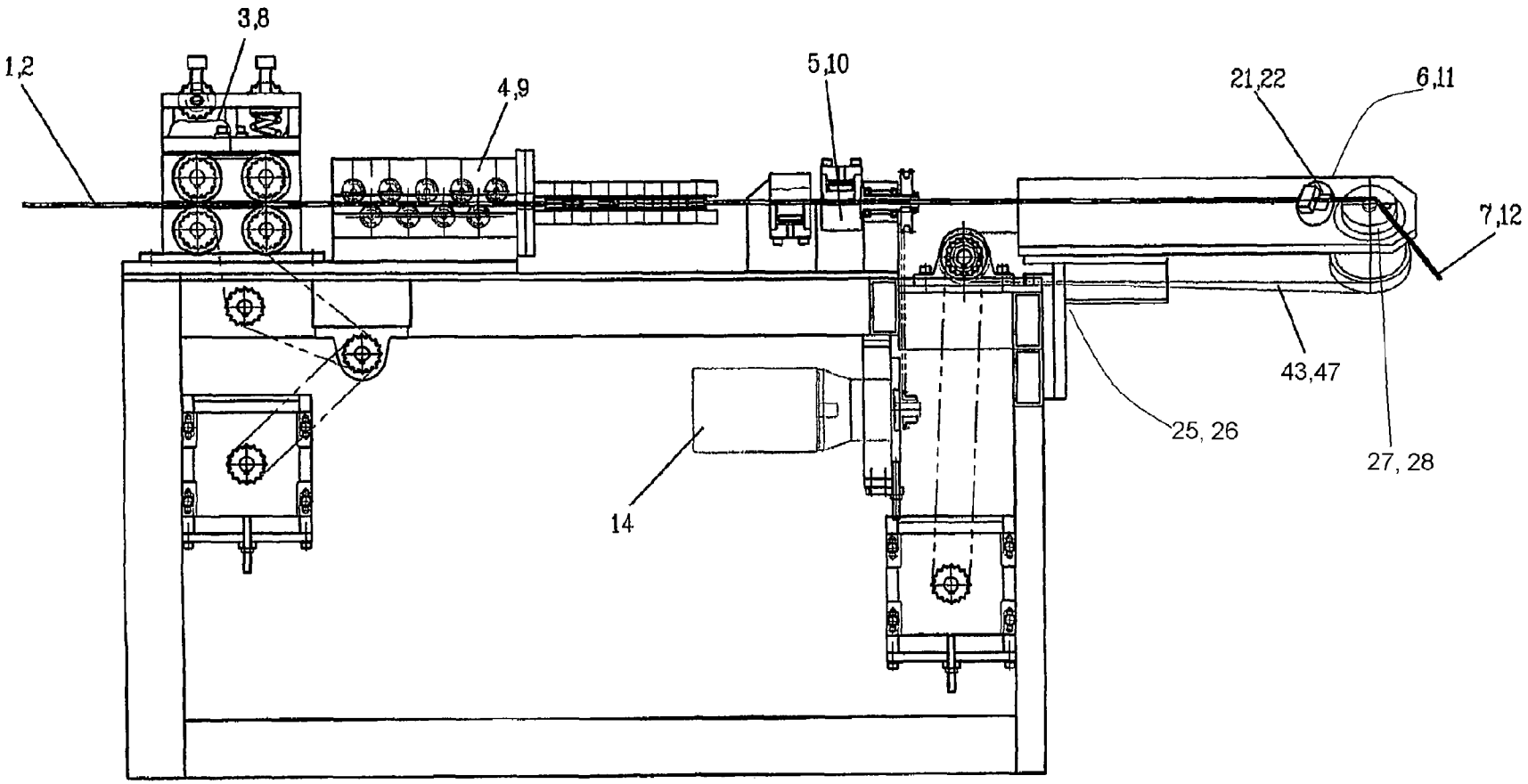
FIG. 2 presents a side view of a machine according to a version of the invention.

After production of a part is completed, a cutter (21), as shown in FIG. 2, may cut and separate the part from the remaining material.

The advancement, straightening, bending and change of bending plane mechanisms are driven by motors, through appropriate mechanisms, where the referred motors are controlled and driven by a central controlling unit (19). A terminal (20) may be used as an interface between the controlling unit and the user, where all programming is implemented.

The material (2) is being processed simultaneously in parallel with the material (1), where the material (2) is fed on a second feed path through the advancement mechanism (8), is straightened through the straightening mechanism (9), advances to the bending unit (24) and is bent through the bending mechanism (111), is rotated for 3-D bending through the mechanism (10), and is cut after production of the part is completed through the cutter (22).

The advancement mechanism (8) of the second material (2) may be similar to the advancement mechanism (3) of the first material (1), and they may be driven by the same motor (13), through a common driving mechanism (16).

Furthermore, the straightening mechanisms (4) and (9) may be similar. Similar are also the bending mechanisms (6) and (11) for the materials (1) and (2) respectively, which may be driven by a common motor (15), through a common driving mechanism (18).

The mechanism (5) for the changing of the bending plane in space for the material (1) may be similar to the mechanism (10) for the material (2), and they may be driven by a common motor (14), through common driving mechanism.

The two cutters (21) and (22) in the two production lines may be similar and they may be driven by a common driving source.

The controlling unit (19) remains the same for both production lines, and the number of controlled rotation axes is also the same. Similarly, the terminal unit (20), which is used for communication with the user, may be common for both production lines.

According to the present invention, more production lines can be added to the above two-line system, where all production lines have similar mechanisms, where these mechanisms include common driving motors and driving mechanisms.

Furthermore, all production lines have a common controlling unit and a common terminal for communication with the user.

For simplicity, the machine (FIG. 2, FIG. 3), which realizes the method of the present invention is presented below with two production lines. The invention refers to two or more similar production lines, which produce similar parts, disposing common driving motors and driving mechanisms for the machine various mechanisms.

The wire (1) is fed through the roller couples (30) of the advancement mechanism (3), which are driven by the shaft (31), through the chain (32). The wire (2) is fed through the roller couples (33), which are driven by the same shaft (31), through the chain (34). The shaft (31) is rotated by the motor (13), through the chain (35), where the motor (13) is a servomotor controlled by the controller (19).

Consequently, the wires (1) and (2) are fed towards the straightening mechanism (4) and (9) respectively, for straightening of the wires. In this version, the straightening mechanism comprises of a two-level straightening.

The straightened wire (1) is fed towards the mechanism (5) for the selection of the bending plane, which mechanism comprises a fixed gripper (36) and a rotating gripper (37), where the axis of rotation of the gripper (37) coincides with the axis of the wire (1). The rotating gripper (37) is driven by the servomotor (14), through the chain (38), where the servomotor (14) is controlled by the system controller (19). In the second production line for the wire (2), similar mechanisms are in operation, namely a fixed gripper (39) and a rotating gripper (40). The rotating gripper (40) is driven by the same motor (14), through the chain (41).

The change in the bending plane may be implemented as follows. The fixed (36) and the rotating (37) grippers are activated and constrain firmly the wire (1), and the fixed (39) and rotating (40) grippers are activated and constrain firmly the wire (2). Then, the motor (14) drives the rotating grippers (37) and (40), which rotate the wires (1) and (2) respectively relative to the fixed grippers. The torsional deformation of the two wires causes the rotation of the semi-formed products (7) and (12), with respect to the fixed parts of the wires. The rotation of the wires causes permanent plastic deformations due to torsion, thus producing 3-D geometries of products.

Figure 3:
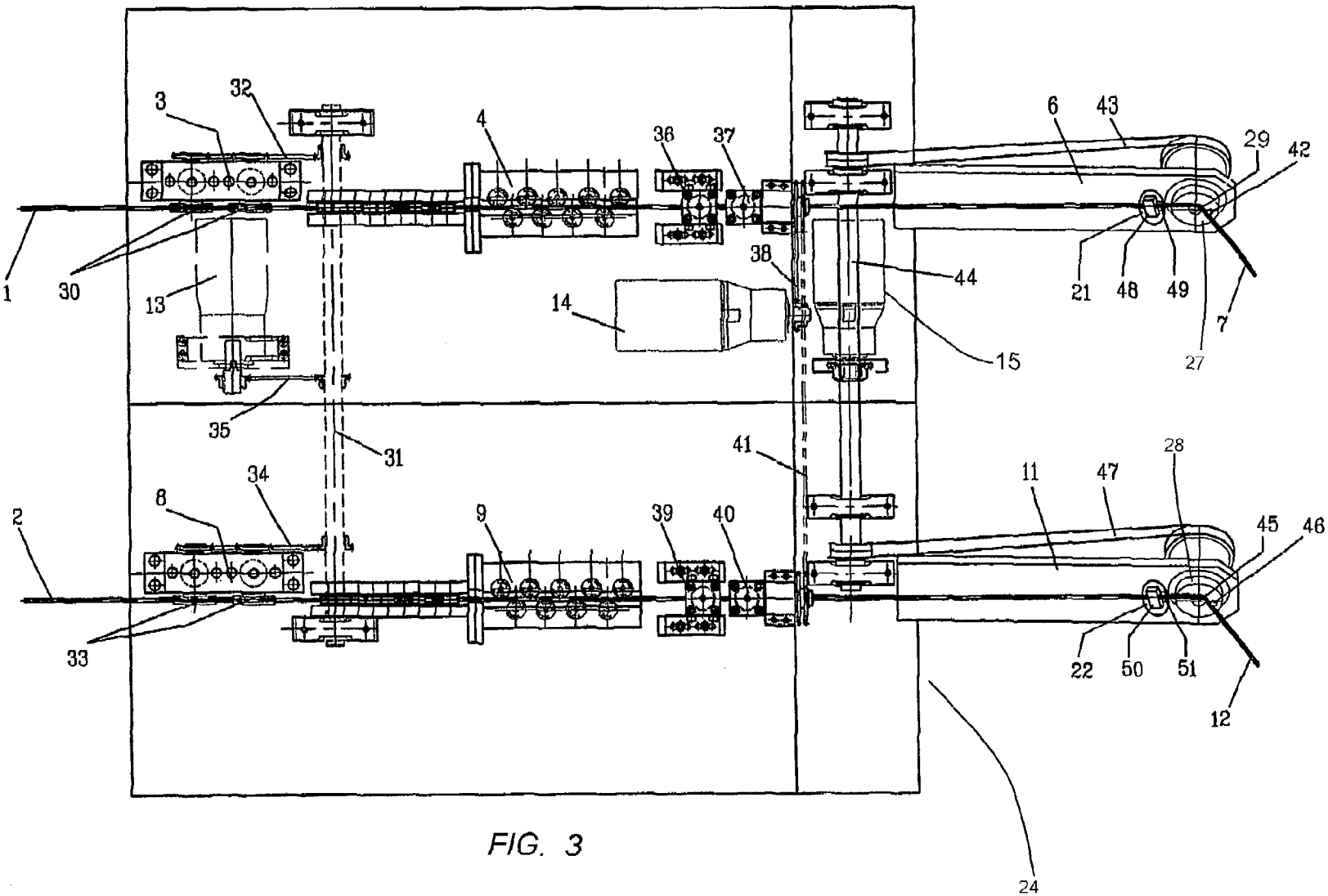
FIG. 3 presents a top view of the machine of FIG. 2.

Consequently, the wire (1) is advanced towards the bending mechanism (6) supported (25) in bending unit (24) as shown in FIGS. 2-3, which mechanism includes a first bending head (27) with a fixed pin (29) and a rotating pin (42), which rotates about the fixed pin (29). The rotating pin is supported on a shaft, and is driven by a shaft (44), through the cogged belt (43). The shaft is driven by the servomotor (15), which is controlled by the controller (19). Simultaneously, the wire (2) is advanced towards the bending mechanism (11) supported (26) in bending unit (24) as shown, which mechanism includes a second bending head (28) with a fixed pin (45) and a rotating pin (46). The rotating pin is supported on a shaft, and is driven by the common shaft (44), through the cogged belt (47). The shaft is driven by the common servomotor (15). Upon activation of the rotor (15), the pins (42) and (46) are rotated about the fixed pins (29) and (45) respectively, and bend the wires, moving along the under-production parts (7) and (12).

The cutter (21) cuts the wire (1) after completion of each formed product part in the first production line. The cutter comprises a moving cutting tool (48), which is driven by a hydraulic cylinder with respect to a fixed cutting tool (49), and finally cuts the material (1). A similar cutter (50, 51) operates in the second production line, where the two cutters (21) and (22) may share a common source of high-pressure oil system.

As will be understood from the aforegoing description, in one version of the invention there is presented a method for simultaneous and in parallel production of similar products, through straightening and bending of wires, wire rods, tubes or any other material of prismatic cross section, which is characterized by production lines, consisting of an advancing mechanism (3) and a straightening mechanism (4) for the material (1), where the material may be advanced and straightened before a bending mechanism (6), where the material is subjected to pre-programmed bendings, where the bending plane can be changed, through the mechanism (5), and of a cutter (21) for the cutting of the material, after each part is concluded, and which is characterized by the existence of more than one similar production lines, which produce similar products, and by the existence of similar mechanisms, driven by common motors and common driving mechanisms for all production lines, such as the advancement mechanisms (3), (8) etc., which are all driven by a common motor (13), through common driving mechanisms (16), the bending mechanisms (6), (11) etc., which are all driven by a common motor (15), through common driving mechanisms (18), the mechanisms for the changing of the bending plane (5), (10) etc., which are all driven by a common motor (14), through common driving mechanisms (17), and the cutters (21), (22) etc., which are all driven by a common power source, and which is characterized by the existence of one central controller (19) for controlling motor operation, and of one terminal station (20) for communication between machine and user and for the machine programming.

As will also be understood from the aforegoing description, in a version of the invention there is presented a method for simultaneous and in parallel production of similar products, through straightening and bending of wires, wire rods, tubes or any other material of prismatic cross section, that is characterized by the existence of more than two similar feeding lines (1), (2) etc., which advance (3), (8) etc., and straighten (4), (9) etc., the material and are driven by a common source (13), and by a bending unit (24) and respective bending mechanisms (6), (11) etc., which perform 2-D bending of the material, and which are driven by a common source (15), and by cutters (21), (22) etc. for the cutting of the material, which are all driven by a common power source, and which is characterized by the existence of one central controller (19) for controlling motor operation, and of one terminal station (20) for communication between machine and user and for the machine programming.

As will further be understood from the aforegoing description, a version of the invention presents a machine for simultaneous and in parallel production of similar products, through straightening and bending of wires, wire rods, tubes or any other material of prismatic cross section, which is characterized by production lines, consisting of an advancing mechanism (3) and a straightening mechanism (4) for the material (1), where the material is advanced and straightened towards a bending unit (24) with a respective bending mechanism (6), where the material is subjected to pre-programmed bendings, where the bending plane can be changed, through the mechanism (5), and of a cutter (21) for the cutting of the material, after each part is concluded, and which is characterized by the existence of a common motor (13) driving a common shaft (31) for the advancement of all materials (1), (2) etc., towards the advancement mechanisms (3), (8) etc., through the roller couples (3), (8) etc., which are driven be the chains (32), (34) etc., by the existence of a common motor (14) driving a common shaft (17) for the changing of the bending plane, which is performed at the mechanisms (5), (10) etc., or through the chains (38), (41) etc., by a common motor (14); a common motor (15) driving a common shaft (44) for the bending of the wires (1), (2) etc., on the bending mechanisms (6), (11) etc., where the rotating pins (42), (46) etc., bend the materials around the fixed pins (29), (45) etc., through the belts (43), (47) etc., by the existence of a common power source for driving the moving cutting tool on the fixed tool of the cutters (21), (22) etc., for the cutting of each part (7), (12) etc., after its production is completed, and which may include one central controller (19) for controlling motor operation, and of one terminal station (20) for communication between machine and user and for the machine programming.

The machine operation is programmed through a communication terminal (20), the operation of the servomotors and consequently the motion of each mechanism is controlled by a controller (19). These mechanisms may include the advancement of the wires, the selection of the bending plane and the wire bending.

In the case of a machine of the present invention that can only perform bending on one plane and not 3-D bending, the mechanisms (5) and (10) for changing the bending plane, and the motor (14) transmission mechanisms may be omitted.

The 3-D bending mechanism may be of different construction. For example, the bending mechanisms (6) and (11) can be rotated about the axes of the wires (1) and (2) respectively, in order to obtain the changing of the bending plane.

The straightening mechanisms (4) and (9) may be of the two plane type or may be of the rotor type.

The present invention is characterized by the straightening and bending of a number of similar wires, on a number of similar production lines, where similar products may be produced.

Furthermore, it is characterized by the common driving of similar mechanisms by a common servomotor, and by the existence of one common controller and one terminal unit for communication by the user.

The machine of the present invention exhibits the following advantages: When, for example, the machine operates with three feeding lines, it has the same production capacity with this plurality of three independent machines, operating at the same speed. The machine is much cheaper, due to common motors, mechanisms and controller. The machine occupies less space.

The invention leads to the construction of a machine, which can maintain high production capacity, due to existence of more than one wire-feeding lines, even during operation at lower speeds.

Various exemplary devices and methods have been illustrated in the accompanying drawings and described in the foregoing detailed description but it will be understood that the claims to the devices and methods shown and described are not limited to the particular embodiments described herein, as these may be capable of numerous rearrangements, modifications, and substitutions without departing from the scope and spirit of the claims set forth below. Consistent with legal precedent, the spirit and scope of the appended claims should not be limited to the description of the preferred versions contained herein. Accordingly, the techniques and structures described and illustrated herein should be understood to be illustrative only and not limiting upon the scope of the present invention. The scope of the present invention is defined by the appended claims, including known equivalents and unforeseeable equivalents at the time of filing of this application.

What is claimed is:

1. A machine for simultaneous parallel production of products from wire comprising:

at least two wire advancement mechanisms;

a first drive shaft kinematically connecting said at least two advancement mechanisms for common motion;

a first motor operatively linked to said first drive shaft for driving said at least two advancement mechanisms in common;

at least two wire straightening mechanisms each being respectively disposed for receiving wire from a respective one of said at least two wire advancement mechanisms;

at least two wire bending mechanisms each being respectively disposed so as to receive wire each from a respective one of said at least two wire straightening mechanisms;

said wire bending mechanisms each including a respective rotary shaft;

a second drive shaft kinematically connecting said at least two wire bending mechanisms for common motion;

a second motor operatively linked to said second drive shaft for driving said at least two bending mechanisms in common; and, a control unit operatively controlling said first and second motors for commonly advancing two wires and for simultaneously forming wire products at each of said at least two bending mechanisms.

2. The machine for simultaneous parallel production of products from wire as recited in claim 1, wherein:

at least one of said at least two wire advancement mechanisms comprises roller couples.

3. A machine for simultaneous parallel production of products from wire as recited in claim 2, further comprising:

a chain drive connected to said first drive shaft and operatively linked to said roller couples for driving said roller couples.

4. The machine for simultaneous parallel production of products from wire as recited in claim 1, wherein:

at least one of said at least two wire straightening mechanisms comprises a two-level straightening mechanism.

5. A machine for simultaneous parallel production of products from wire as recited in claim 1, further comprising:

at least two bending plane selection mechanisms each being respectively disposed for receiving wire each from a respective one of said at least two wire straightening mechanisms and for passing wire each to a respective one of said at least two wire bending mechanisms.

6. A machine for simultaneous parallel production of products from wire as recited in claim 5, further comprising:

a third motor linked to drive in common said at least two bending plane selection mechanisms for selectively rotating wires received in said bending mechanisms.

7. A machine for simultaneous parallel production of products from wire as recited in claim 6, further comprising:

at least one of said two bending plane selection mechanisms comprising a pair of wire grippers, one of said wire grippers comprising a fixed gripper, and a second of said wire grippers comprising a rotating gripper.

8. The machine for simultaneous parallel production of products from wire as recited in claim 7, wherein:

said third motor drives said rotating gripper in rotation for selectively rotating relative to said fixed gripper a wire gripped by said rotating gripper.

9. A machine for simultaneous parallel production of products from wire as recited in claim 5, further comprising:

at least two wire cutters respectively disposed for cutting wire between respective ones of said at least two bending plane selection mechanisms and respective ones of said at least two wire bending mechanisms.

10. A machine for simultaneous parallel production of products from wire as recited in claim 9, further comprising:

a common power source connected to drive said at least two wire cutters.

11. A machine for simultaneous parallel production of products from wire as recited in claim 1, further comprising:

a fixed pin in at least one of said at least two wire bending mechanisms; and, a rotating pin in said at least one of said at least two wire bending mechanisms.

12. A method for simultaneous parallel production of products from wire comprising the steps of:

advancing a first wire from a supply through a first wire advancement mechanism by operating a first motor;

simultaneously advancing a second wire from a second supply through a second wire advancement mechanism by operating the first motor;

passing the first wire through a first straightening mechanism to straighten the first wire;

simultaneously passing the second wire through a second straightening mechanism to straighten the second wire;

feeding the first wire through a first bending plane selection mechanism configured for selectively rotating the first wire about its axis;

simultaneously feeding the second wire through a second bending plane selection mechanism configured for selectively rotating the second wire about its axis;

receiving the first wire at a first bending mechanism;

simultaneously receiving the second wire at a second bending mechanism; and, operating a second motor to concurrently operate the first and second wire bending mechanisms in common so as to simultaneously bend the first and second wires.

13. A method for simultaneous parallel production of products from wire as recited in claim 12, further comprising the step of:

operating a third motor to concurrently operate the first and second bending plane selection mechanisms so as to simultaneously rotate the first and second wires at the wire bending mechanisms.

14. A method for simultaneous parallel production of products from wire as recited in claim 13, further comprising the step of:

operating the second motor to concurrently operate the first and second wire bending mechanisms in common so as to simultaneously bend the first and second wires within a rotated bending plane.

15. A method for simultaneous parallel production of products from wire as recited in claim 14, further comprising the step of:

cutting the first and second wires for releasing wire products from the first and second wire bending mechanisms.

16. The method for simultaneous parallel production of products from wire as recited in claim 15, wherein:

the step of cutting the first and second wires for releasing wire products from the first and second wire bending mechanisms further comprises activating cutters to cut the first and second wires.

17. A machine for simultaneous parallel production of products from wire comprising:

at least two wire advancement mechanisms;

a first drive shaft kinematically connecting said at least two advancement mechanisms for common motion;

a first motor operatively linked to said first drive shaft for driving said at least two advancement mechanisms in common;

at least two bending plane selection mechanisms each being respectively disposed for receiving wire each from a respective one of said at least two wire advancement mechanisms;

a third motor linked to drive in common said at least two bending plane selection mechanisms for selectively rotating the respective wires;

at least two wire bending mechanisms each being respectively disposed so as to receive wire each from a respective one of said at least two bending plane selection mechanisms;

a second drive shaft kinematically connecting said at least two wire bending mechanisms for common motion;

a second motor operatively linked to said second drive shaft for driving said at least two bending mechanisms in common; and, a control unit operatively controlling said first and second motors for commonly advancing two wires and for simultaneously forming wire products at each of said at least two bending mechanisms.

18. The machine for simultaneous parallel production of products from wire as recited in claim 17, wherein:

at least one of said at least two wire advancement mechanisms comprises roller couples.

19. A machine for simultaneous parallel production of products from wire as recited in claim 18, further comprising:

a chain drive connected to said first drive shaft and operatively linked to said roller couples for driving said roller couples.

20. A machine for simultaneous parallel production of products from wire as recited in claim 17, further comprising:

at least two wire cutters respectively disposed for cutting wire between respective ones of said at least two bending plane selection mechanisms and respective ones of said at least two wire bending mechanisms.

21. A machine for simultaneous parallel production of products from wire as recited in claim 20, further comprising:

a common power source connected to drive said at least two wire cutters.

22. A machine for production of wire products comprising:

a bending unit;

said bending unit including a first bending mechanism;

said first bending mechanism being in a first production line;

said bending unit including a second bending mechanism;

said second bending mechanism being in a second production line spaced from said first production line;

a common rotary drive shaft operatively connected to said first and second bending mechanisms;

a motor kinematically linked to said common rotary drive shaft and configured to controllably drive said common rotary drive shaft;

said bending unit including a first support configured to support said first bending mechanism;

said bending unit including a second support configured to support said second bending mechanism;

said first bending mechanism including a first rotary shaft;

a first bending head configured to bend a first wire fed into said first production line, said first bending head is operatively connected to said first rotary shaft;

said second bending mechanism including a second rotary shaft; and, a second bending head configured to bend a spaced second wire fed into said spaced second production line, said second bending head is operatively connected to said second rotary shaft.

23. A machine for production of wire products as recited in claim 22, further comprising:

first and second gears respectively connected to said motor and to said common rotary drive shaft.

24. A machine for production of wire products as recited in claim 23, further comprising:

a chain configured to kinematically link said gears.

25. A machine for production of wire products as recited in claim 22, further comprising:

a first cutter configured to cut wire from said first bending mechanism; and, a second cutter configured to cut wire from said second bending mechanism.

26. A machine for production of wire products as recited in claim 22, further comprising:

a belt driven by said common rotary drive shaft.

27. A machine for production of wire products as recited in claim 26, further comprising:

a second belt driven by said common rotary drive shaft.

28. The machine for production of wire products as recited in claim 27, wherein:

said first belt is configured to drive said first rotary shaft; and, said second belt is configured to drive said second rotary shaft.

29. A machine for production of wire products as recited in claim 22, further comprising:

said first bending head includes a first pin configured to be driven by said first rotary shaft; and, said second bending head includes a second pin configured to be driven by said second rotary shaft.

30. The machine for production of wire products as recited in claim 22, further comprising:

first and second gears respectively connected to said motor and to said common rotary drive shaft;

a chain configured to kinematically link said gears;

a first belt driven by said common drive shaft, said first belt being configured to drive said first rotary shaft;

a second belt driven by said common drive shaft, said second belt being configured to drive said second rotary shaft;

said first bending head including a first pin configured to be driven by said first rotary shaft; and, said second bending head including a second pin configured to be driven by said second rotary shaft.

31. A machine for production of wire products comprising:

a first advancement mechanism configured to advance wire;

a second advancement mechanism configured to advance wire;

a common rotary drive shaft operatively connected to said first and second advancement mechanisms;

a motor configured to controllably drive said common rotary drive shaft;

a first set of gears respectively connected to said motor and to said common rotary drive shaft;

a first straightening mechanism configured to receive wire advanced from said first advancement mechanism;

a second straightening mechanism configured to receive wire advanced from said second advancement mechanism;

a first gripper configured to receive wire from said first straightening mechanism;

a first rotating gripper configured to receive wire from said first gripper;

a second gripper configured to receive wire from said second straightening mechanism;

a second rotating gripper configured to receive wire from said second gripper; and, a bending unit configured to receive wire from said first and second rotating grippers.

32. A machine for production of wire products as recited in claim 31, further comprising:

at least one chain configured to kinematically link said first set of gears.

33. A machine for production of wire products as recited in claim 31, further comprising:

a second motor operatively connected to at least one of said first and second rotating grippers.

34. A machine for production of wire products as recited in claim 33, further comprising:

a second set of gears respectively connected to said second motor and to said at least one of said first and second rotating grippers.

35. A machine for production of wire products as recited in claim 34, further comprising:

at least one chain configured to kinematically link said second set of gears.

36. A machine for production of wire products as recited in claim 33, further comprising:

said second motor being operatively connected to said first rotating gripper and to said second rotating gripper;

respective gears respectively connected to said second motor, to said first rotating gripper, and to said second rotating gripper; and, a chain configured to kinematically link said gear connected to said second motor and said gear connected to said first rotating gripper.

37. A machine for production of wire products as recited in claim 36, further comprising:

a second chain configured to kinematically link said gear connected to said second rotating gripper and another gear connected to said second motor.

38. The machine for production of wire products as recited in claim 31, wherein:

at least one of said first and second advancement mechanisms comprises roller couples.

39. The machine for production of wire products as recited in claim 31, wherein:

at least one of said first and second straightening mechanisms comprises a two-level straightening mechanism.

40. The machine for production of wire products as recited in claim 31, further comprising:

plural commonly driven bending mechanisms in said bending unit.

41. The machine for production of wire products as recited in claim 31, further comprising:

a first cutter configured to receive wire advanced by said first advancement mechanism.

42. A machine for production of wire products comprising:

a bending unit;

said bending unit including a first bending mechanism;

said bending unit including a second bending mechanism;

a first motor configured to drive said first and second bending mechanisms;

a first bending plane selection mechanism configured to selectively torsionally axially rotate wire passing therethrough to said first bending mechanism; and, a second bending plane selection mechanism configured to selectively torsionally axially rotate wire passing therethrough to said second bending mechanism.

43. A machine for production of wire products as recited in claim 42, further comprising:

a second motor configured to drive said first and second bending plane selection mechanisms to effect the selective torsional axial rotation of the respective wires passing through said first and second bending plane selection mechanisms.

44. A machine for production of wire products as recited in claim 43, further comprising:

at least one chain configured to kinematically link said second motor to at least one of said first and second bending plane selection mechanisms.

45. A machine for production of wire products as recited in claim 42, further comprising:

a first set of grippers associated with said first bending plane selection mechanism;

said first set of grippers including a first rotating gripper; and, a second set of grippers associated with said second bending plane selection mechanism;

said second set of grippers including a second rotating gripper.

46. A machine for production of wire products as recited in claim 45, further comprising:

a second motor configured to drive said first rotating gripper and said second rotating gripper.

47. A machine for production of wire products as recited in claim 46, further comprising:

at least one chain configured to kinematically link said second motor and said first rotating gripper.

48. A machine for production of wire products as recited in claim 47, further comprising:

a second chain configured to kinematically link said second motor and said second rotating gripper.

49. A machine for production of wire products as recited in claim 42, further comprising:

said first bending mechanism including a first rotary shaft; and, said second bending mechanism including a second rotary shaft.

50. A machine for production of wire products as recited in claim 49, further comprising:

said first bending mechanism including a first bending head operatively connected to said first rotary shaft; and, said second bending mechanism including a second bending head operatively connected to said second rotary shaft.

51. A machine for production of wire products as recited in claim 50, further comprising:

a first rotary pin connected to said first bending head; and, a second rotary pin connected to said second bending head.

52. A machine for production of wire products as recited in claim 51, further comprising:

a fixed pin in said first bending head.

53. A machine for production of wire products as recited in claim 42, further comprising:

a common rotary drive shaft kinematically linked to said first motor and to said first and second bending mechanisms.

54. A machine for production of wire products as recited in claim 53, further comprising:

gears respectively connected to said first motor and to said common rotary drive shaft; and, a chain kinematically linking said gears.

55. A machine for production of wire products comprising:

a bending unit;

said bending unit including a first bending mechanism;

said bending unit including a second bending mechanism;

a first bending plane selection mechanism configured to selectively torsionally axially rotate wire passing therethrough to said first bending mechanism;

a second bending plane selection mechanism configured to selectively torsionally axially rotate wire passing therethrough to said second bending mechanism; and, a motor configured to drive said first and second bending plane selection mechanisms to effect the selective torsional axial rotation of the respective wires passing through said first and second bending plane selection mechanisms.

56. A machine for production of wire products as recited in claim 55, further comprising:

at least one chain configured to kinematically link said motor to at least one of said first and second bending plane selection mechanisms.

57. A machine for production of wire products as recited in claim 55, further comprising:

a first set of grippers associated with said first bending plane selection mechanism;

said first set of grippers including a first rotating gripper; and, a second set of grippers associated with said second bending plane selection mechanism;

said second set of grippers including a second rotating gripper.

58. A machine for production of wire products as recited in claim 57, further comprising:

at least one chain kinematically linking said motor and said first rotating gripper.

59. A machine for production of wire products as recited in claim 55, further comprising:

a respective rotary shaft connected to each of said first and second bending mechanisms.

60. A method for production of wire products comprising the steps of:

feeding a first wire through a first bending plane selection mechanism;

feeding a second wire through a second bending plane selection mechanism;

receiving the first wire at a first bending mechanism;

receiving the second wire at a second bending mechanism; and, operating a first motor to drive the first and second bending plane selection mechanisms to selectively torsionally axially rotate the first and second wires.

61. A method for production of wire products as recited in claim 60, further comprising the step of:

driving the first and second bending mechanisms to bend the first and second wires.

62. The method for production of wire products as recited in claim 61, wherein:

the step of driving the first and second bending mechanisms comprises operating a second motor to drive the first and second bending mechanisms.

63. A method for production of wire products as recited in claim 61, further comprising the step of:

cutting at least one of the first and second wires.

64. A method for production of wire products as recited in claim 60, further comprising the step of:

advancing the first and second wires by operating wire advancement mechanisms.

65. A method for production of wire products as recited in claim 60, further comprising the step of:

passing the first and second wires through straightening mechanisms.

66. A method for production of wire products as recited in claim 60, further comprising the step of:

activating cutters to cut the first and second wires.

67. A machine for production of wire products comprising:

a first advancement mechanism configured to advance wire;

a second advancement mechanism configured to advance wire;

a first common rotary drive shaft operatively linked to said first and second advancement mechanisms;

a first motor configured to controllably drive said first common rotary drive shaft;

a first straightening mechanism configured to receive wire advanced from said first advancement mechanism;

a second straightening mechanism configured to receive wire advanced from said second advancement mechanism;

a first gripper configured to receive wire from said first straightening mechanism;

a first rotating gripper configured to receive wire from said first gripper;

a second gripper configured to receive wire from said second straightening mechanism;

a second rotating gripper configured to receive wire from said second gripper;

a second motor operatively connected to said first rotating gripper and to said second rotating gripper;

respective gears respectively connected to said second motor, to said first rotating gripper, and to said second rotating gripper;

a chain configured to kinematically link said gear connected to said second motor and said gear connected to said first rotating gripper;

a second chain configured to kinematically link said gear connected to said second rotating gripper with another gear connected to said second motor;

a bending unit configured to receive wire from said first and second rotating grippers;

said bending unit including a first bending mechanism;

said first bending mechanism including a first rotary shaft;

a first bending head operatively connected to said first rotary shaft;

said bending unit including a second bending mechanism;

said second bending mechanism including a second rotary shaft;

a second bending head operatively connected to said second rotary shaft;

a second common rotary drive shaft operatively connected to said first and second bending mechanisms;

a third motor configured to controllably drive said second common rotary drive shaft;

a first gear connected to said third motor and a second gear connected to said second common rotary drive shaft;

a third chain configured to operatively link said first and second gears;

a first belt driven by said second common drive shaft, said first belt being configured to drive said first rotary shaft;

a second belt driven by said second common drive shaft, said second belt being configured to drive said second rotary shaft;

said first bending head including a first pin configured to be driven by said first rotary shaft;

said second bending head including a second pin configured to be driven by said second rotary shaft.

* * * * *